US008322296B2

(12) United States Patent
Tiraby et al.

(10) Patent No.: US 8,322,296 B2
(45) Date of Patent: Dec. 4, 2012

(54) SUBMERSIBLE APPARATUS INCLUDING FLEXIBLE WATERPROOFING MEMBRANES

(75) Inventors: Christophe Tiraby, Sceaux (FR); Pascal Caestecker, Paris (FR); Frederic Segonds, Paris (FR)

(73) Assignee: Christophe Tiraby, Sceaux (FR)

( * ) Notice: Subject to any disclaimer, the term of this patent is extended or adjusted under 35 U.S.C. 154(b) by 198 days.

(21) Appl. No.: 12/598,976

(22) PCT Filed: May 5, 2008

(86) PCT No.: PCT/EP2008/055487

§ 371 (c)(1),
(2), (4) Date: Nov. 5, 2009

(87) PCT Pub. No.: WO2008/141913

PCT Pub. Date: Nov. 27, 2008

(65) Prior Publication Data

US 2010/0139545 A1 Jun. 10, 2010

(30) Foreign Application Priority Data

May 10, 2007 (FR) ..... 07 54971

(51) Int. Cl.
*B63G 8/08* (2006.01)
*B63H 1/30* (2006.01)

(52) U.S. Cl. ..... 114/337; 440/13

(58) Field of Classification Search ..... 114/312, 114/313, 337, 339, 340; 440/13, 14
See application file for complete search history.

(56) References Cited

U.S. PATENT DOCUMENTS 1,298,333 A * 3/1919 Grebe ..... 359/406
2,902,671 A * 9/1959 Pitt ..... 340/437
2,962,283 A * 11/1960 Casey ..... 472/129
3,361,106 A * 1/1968 Hildebrand ..... 440/15
4,057,226 A * 11/1977 de Mos et al. ..... 366/244
5,704,309 A * 1/1998 Kohnen ..... 114/312

(Continued)

FOREIGN PATENT DOCUMENTS

EP 0 867 360 A2 9/1998
EP 1 535 654 A1 1/2005
GB 616280 A 1/1949

(Continued)

OTHER PUBLICATIONS

International Search Report, dated Jan. 12, 2008, from corresponding PCT/EP2008/055487.

*Primary Examiner* — Daniel Venne
*Assistant Examiner* — Anthony Wiest
(74) *Attorney, Agent, or Firm* — Young & Thomspon

(57) ABSTRACT

A submersible apparatus (10) which can be fully submerged in a liquid medium, includes: a sealed hollow body (12) having a longitudinal main axis (A); at least one driving member (14, 36, 52) for moving the apparatus (10) horizontally and/or vertically, which can co-operate with the medium in which the apparatus (10) is submerged and which can move in relation to the hollow body (12) through an opening (22, 44, 56) provided in the wall of the body (12); and elements (18, 40, 64) for actuating the driving member (14, 36, 52), which are disposed inside the hollow body (12). The invention is characterized in that the opening (22, 44, 56) is sealed by a flexible membrane (24, 50, 58) which can deform and co-operate with the driving member (14, 36, 52) as the driving member (14, 36, 52) moves through the opening in order to move the apparatus (10).

12 Claims, 6 Drawing Sheets

U.S. PATENT DOCUMENTS

| | | | | |
|---|---|---|---|---|
| 6,079,348 | A | 6/2000 | Rudolph | |
| 6,138,604 | A * | 10/2000 | Anderson et al. | 114/332 |
| 6,671,995 | B1 * | 1/2004 | Harkin | 43/17.6 |
| 2006/0000137 | A1 | 1/2006 | Alvarado et al. | |

FOREIGN PATENT DOCUMENTS

| | | | |
|---|---|---|---|
| JP | 56-086890 | A | 7/1981 |
| JP | 60-011780 | A | 1/1985 |

* cited by examiner

SUBMERSIBLE APPARATUS INCLUDING FLEXIBLE WATERPROOFING MEMBRANES

The invention proposes a submersible apparatus with autonomous propulsion, comprising improved sealing means.

The invention more particularly proposes a submersible apparatus adapted to be submerged entirely in a liquid medium comprising a hollow body closed in a fluid tight manner, having a main longitudinal axis, at least one driving member for moving the apparatus in horizontal displacement and/or in vertical displacement, which is movable with respect to the hollow body through an opening arranged in the wall of the body and which comprises at least one planar palette, of longitudinal main orientation, which extends outside the hollow body and which is arranged at the level of an axial end of the body to cooperate with the medium in which the apparatus is submerged, actuating means for actuating the driving member, which is arranged inside the hollow body, a flexible membrane to seal the opening in a fluid tight manner, which is adapted to deform and to cooperate with the driving member during the movement of the driving member through the opening, for the displacement of the apparatus, the driving member comprising a portion of the palette, connecting the palette to the actuating means, which extends through the flexible membrane in a fluid tight manner.

There are many submersible apparatuses having small dimensions, i.e. about a few tenths of centimeters, for example miniaturized submarines, or many other robots imitating the swim of a fish.

Document US-A-2006/0000137 describes such an apparatus in a fish shape for which the rear driving member is in the shape of caudal fin.

The driving member is deformable elastically, and it is fixed to the hollow body at the level of its front base, so that the front base seals in a fluid tight manner a rear opening of the body through which the connecting portion extends.

Such a mode for fixing the front base of the driving member on the body is somewhat complex to realize because the shape of the front base must be complementary to the shape of the opening.

Also, the stresses exerted on the driving member, to cause its deformation, can cause a dissociation of the front base of the driving member with the body.

Moreover, the dimensions of the opening are relatively substantial, to permit the passage of the various components of the apparatus, these dimensions of the opening implying a domed aspect of the body, which is not compatible with a design in a fish shape.

There are also sealing means for submersible apparatuses via a toric joint which is pressed on a shaft.

The purpose of the invention is to propose a submersible apparatus comprising sealing means of a somewhat simple design, which are adapted to the movements of the driving member, and for which the outer aspect of the body of the apparatus can have a frayed shape.

To this end, the invention proposes a submersible apparatus as previously described, characterized in that the driving member is guided in oscillation with respect to the body, around at least one pivoting axis perpendicular to the main longitudinal axis, via the flexible membrane, so that the said at least one pivoting axis is located at the level of the flexible membrane.

According to other features of the invention, taken separately or in combination:

- the connecting portion comprises an internal axial end arranged inside the body, which cooperates with a generally longitudinal fork of the actuating means, the said fork being mounted articulated with respect to the body around an axis parallel with said at least one pivoting axis of the driving member;
- the driving member is articulated with respect to the body around a pivoting axis of vertical orientation which is arranged at a rear end of the body, and the driving member comprises a longitudinal vertical palette;
- the driving member is articulated with respect to the body around a pivoting axis of transverse orientation which is arranged at the rear end of the body, and the driving member comprises an horizontal palette;
- the apparatus comprises a second driving member articulated with respect to the body around a pivoting axis of transverse orientation which is arranged at a front end of the body, and the driving member comprises a horizontal palette;
- the driving member is movable with respect to the body so as to modify the total volume of the apparatus;
- the driving member comprises a central plunger which is mounted movable with respect to the hollow body along a vertical axis and which is connected to the flexible membrane to deform the membrane generally along the said vertical axis;
- the plunger of the driving member is mounted movable with respect to the body, through the opening which is coaxial with the said vertical axis;
- the body has an oblong main shape of revolution around its main longitudinal axis and the actuating means comprises at least one actuator arranged longitudinally close to the centre of the body;
- the fork is arranged longitudinally near an axial end of the body, and the actuating means comprises a connecting linkage for connecting the actuator with the fork;
- the actuators are mounted on a supporting plate which is fixed to the body;
- the apparatus comprises an electronic device for controlling the actuating means, which is mounted on the supporting plate;
- the body comprises several openings, each of them being associated with a driving member, and several flexible membranes, each of them sealing one of the openings of the body;
- the body comprises two half hulls which are manufactured by overmoulding around the flexible membranes;
- the apparatus comprises a lower skittle which is fixed to the body in a dismountable manner;
- the means for mounting the skittle are carried out so as to allow an adjustment of the position of the skittle longitudinally with respect to the body;
- the apparatus comprises at least a proximity sensor comprising a stem extending through an associated opening of the body and it comprises a flexible membrane sealing the said associated opening, which cooperates with the stem.

Other features and advantages of the invention will appear from the reading of the following detailed description for the comprehension of which one will refer to the annexed drawings in which.

Figure 1:
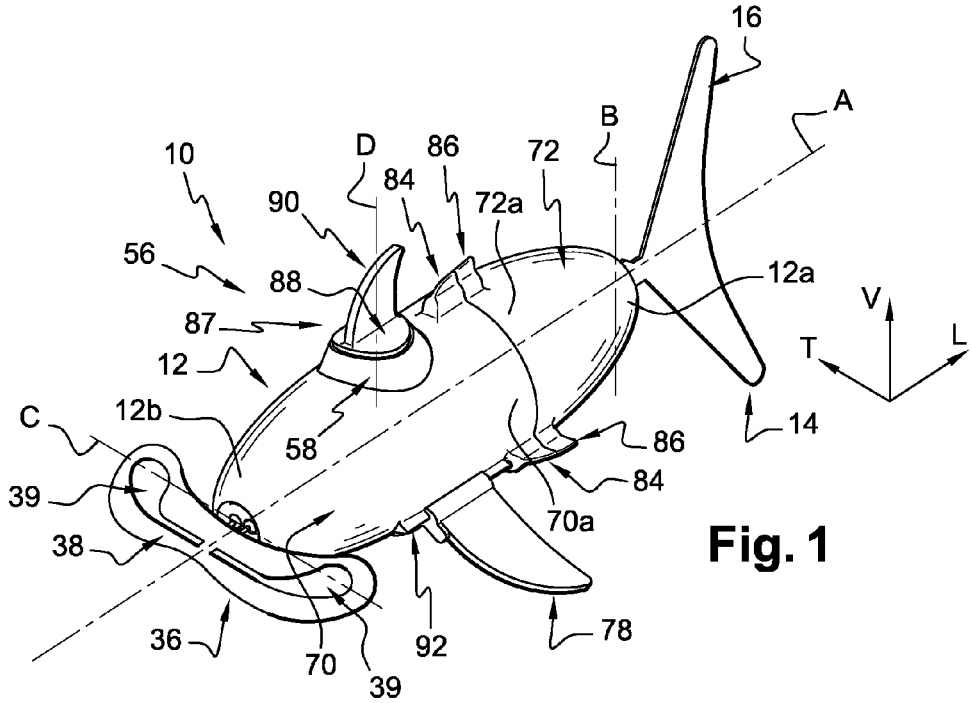
FIG. 1 is a schematic perspective representation of the submersible apparatus according to the invention.

For the description of the invention, it will be used, in a non limiting manner, the orientations vertical, longitudinal, and transverse, with particular reference to the axis V, L, T of the trihedron shown in the drawings.

It will also be used the orientation from front to rear as being the longitudinal direction, and from left to right when referring to FIG. 1.

In the following description, identical, analogous or similar elements will be designated by the same numeral references.

In FIG. 1 is illustrated a submersible apparatus 10 which is intended to be plunged in a liquid ambient medium such as a volume of water (not illustrated) and which is adapted to move freely in this liquid medium.

The apparatus 10 comprises a hollow body 12 having a longitudinal main axis A and means for actuating the apparatus 10 in displacement in the liquid medium.

As it can be seen in the figures, the body 12 of the apparatus 10 is a hollow element of oblong shape and having a longitudinal main axis A. Moreover, the body 12 is here an element of revolution around the longitudinal main axis A, and its section by an axial plane is generally elliptical, i.e. the diameter of a radial section of the body 12 is greater close to the longitudinal centre of the body 12.

The body 12 consists of a hollow hull comprising a front half hull 70 and a rear half hull 72 which are jointed at the level of their longitudinal facing ends.

Figure 2:
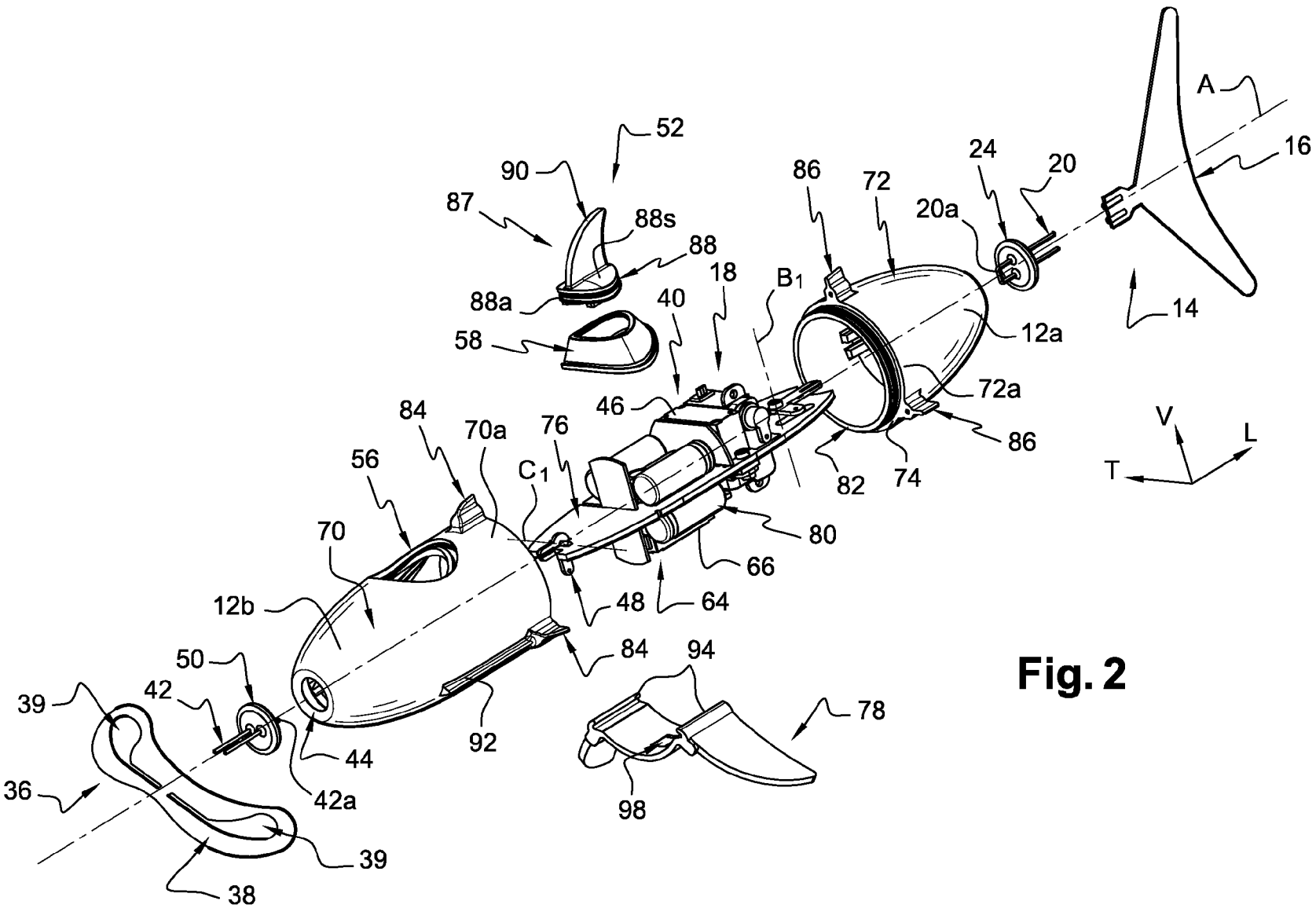
FIG. 2 is a schematic perspective exploded representation of the apparatus illustrated in FIG. 1.

As illustrated in FIG. 2, the sealing of the connection between the half hulls is carried out via an annular ring 82 which extends axially, toward the front, from the front axial end 72*a* of the rear half hull 72.

The ring is intended to be received in the front half hull 70. To this end, the diameter of the outer cylindrical face of the ring 82 is slightly inferior to the internal diameter of the rear end 70*a* of the front half hull 70.

Moreover, the outer cylindrical face of the ring 82 comprises an annular groove which receives a toric sealing joint 74, which is compressed radially between the ring 82 and the rear end 70*a* of the front half hull 70.

Moreover, the front half hull 70 comprises fixing portions 84 which, here, are three and which extend radially, toward the outer, from its rear end 70*a*.

Each fixing portion 84 is adapted to be fixed to an associated fixing portion 86 of the front axial end 72*a* of the rear half hull 72, for example by screwing, for fixing the front half hull 70 with the rear half hull 72.

As it can be seen in FIG. 1, the fixing portions 84, 86 of the front half hull 70 and the rear half hull 72 are moreover formed so as to limit the disturbances produced by the displacement of the apparatus in the liquid medium.

The actuating means of the apparatus 10 in the liquid medium comprises a first driving member 14 arranged at the level of a rear end 12*a* of the body 12, which is designed out so as to cooperate with the liquid medium to provoke a displacement of the apparatus 10 in a horizontal plane, with respect to the horizontal main axis A of body 12.

Here, the first driving member 14 makes it possible to provoke a longitudinal displacement, toward the front, of the apparatus 10 and one rotation of the apparatus 10 around a generally vertical axis.

The first driving member 14 comprises a longitudinal vertical palette 16 which is arranged longitudinally behind and outside of the body 12. The first driving member 14 is mounted movable with respect to the hollow body generally in oscillation around a substantially vertical axis B arranged at the level of the rear longitudinal end 12*a* of the body 12.

The movement of the first driving member 14 with respect to the body 12 is obtained by actuating means 18 which are arranged inside the hollow body 12.

Figure 3:
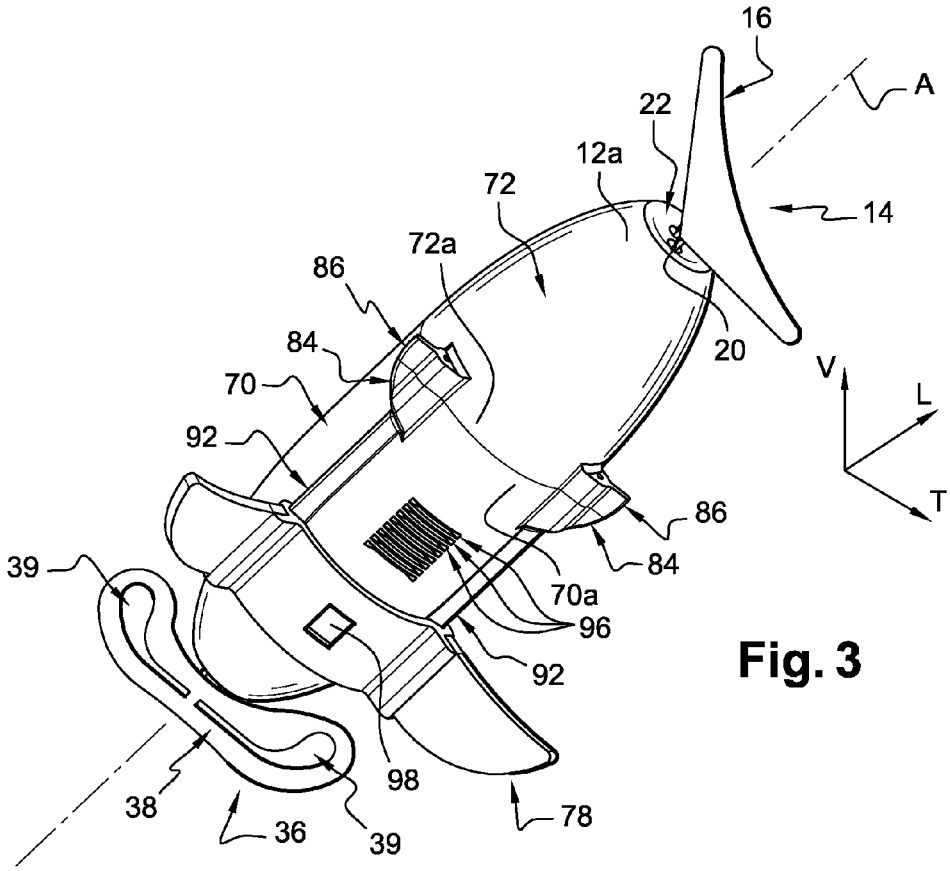
FIG. 3 is an under perspective view of the apparatus illustrated in FIG. 1, showing the means for the mounting of the skittle under the hollow body.
Figure 5:
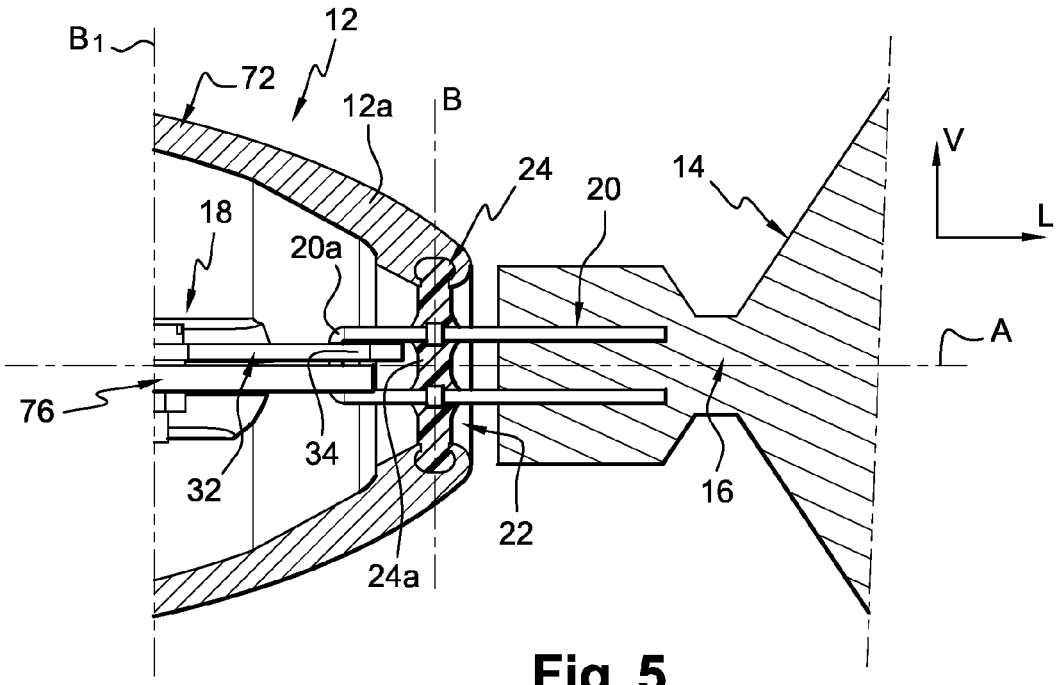
FIG. 5 is a section, along a longitudinal vertical plane, of the apparatus illustrated in FIG. 4, showing the connection of the rear membrane with the body and the driving member.

To connect the palette 16, which is arranged outside the body 12, with the actuating means 18, which are arranged inside the body 12, the first driving member 14 comprises a connecting portion 20 which is fixed to the palette 16 and which extends through a rear opening 22 carried out in the rear longitudinal end 12*a* of the body 12 (FIGS. 3 and 5).

Figure 4:
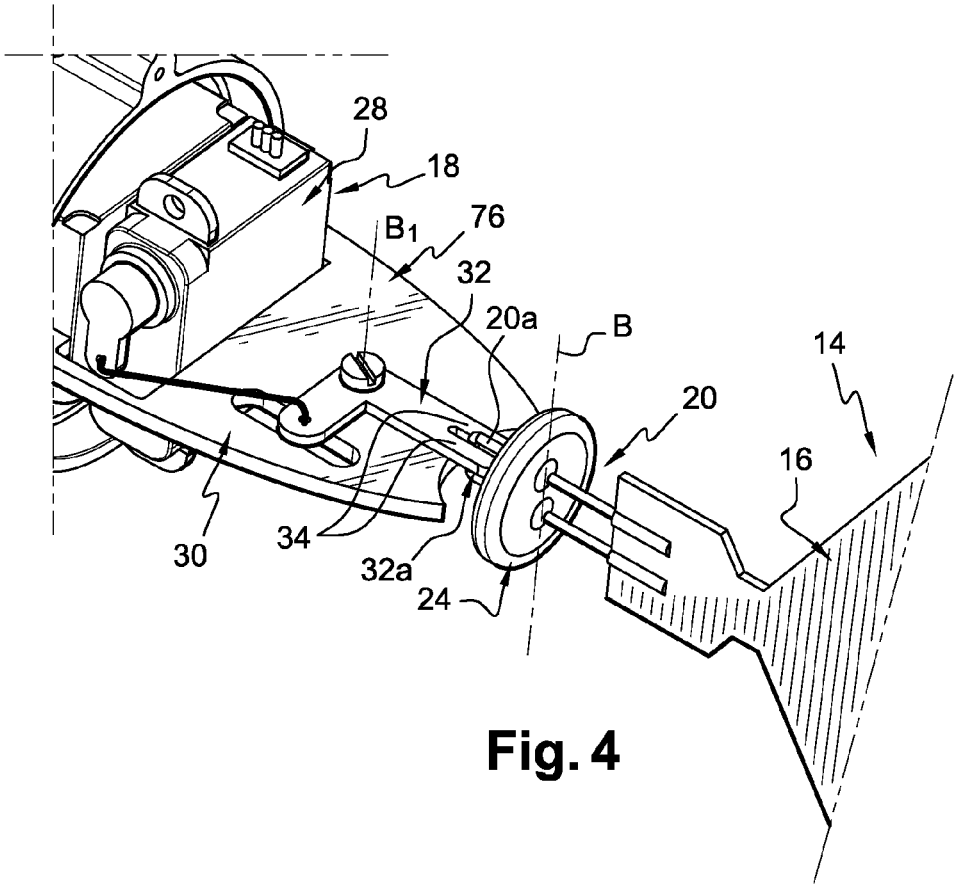
FIG. 4 is a detail in perspective view of the rear of the apparatus illustrated in FIG. 1, showing the connection of the rear driving member with the associated membrane and the actuating means.

As it can be seen more in details in FIGS. 4 and 5, a connecting portion 20 consists of an element having a main longitudinal orientation, which extends toward the front, from the palette 16, and longitudinal free front end 20*a* of which cooperates with the actuating means 18.

In accordance with the invention, and as it can be seen in FIG. 5, the rear opening 22 is sealed in a fluid tight manner by a rear membrane 24 made of a flexible material, which cooperates with the a connecting portion 20 to permit the movement of the driving member 14 with respect to the body 12.

The flexible membrane 24 is thus adapted to be deformed elastically during the oscillation of the palette 16 around the vertical axis B, so as to maintain the rear opening 22 sealed in a fluid tight manner, whatever the position of the first driving member 14 around its axis of oscillation B.

Here, the flexible membrane 24 is manufactured to be deformed elastically during the oscillation of the palette 16, between an initial rest shape toward which it returns elastically, and several deformed shapes. However, it will be understood that the invention is not limited to this embodiment of the flexible membrane, which can become deformed freely, in a non elastic manner.

According to the invention, a connecting portion 20 extends through the rear membrane 24 in a fluid tight manner.

To this end, according to a preferred embodiment, the rear membrane 24 is manufactured by overmoulding around the connecting portion 20.

According to another aspect of the rear membrane 24 according to the invention, the first driving member 14 is connected to the body 12 only via the rear membrane 24 which performs a guiding of the first driving member 14 in oscillation around the vertical axis B.

Figure 6A:
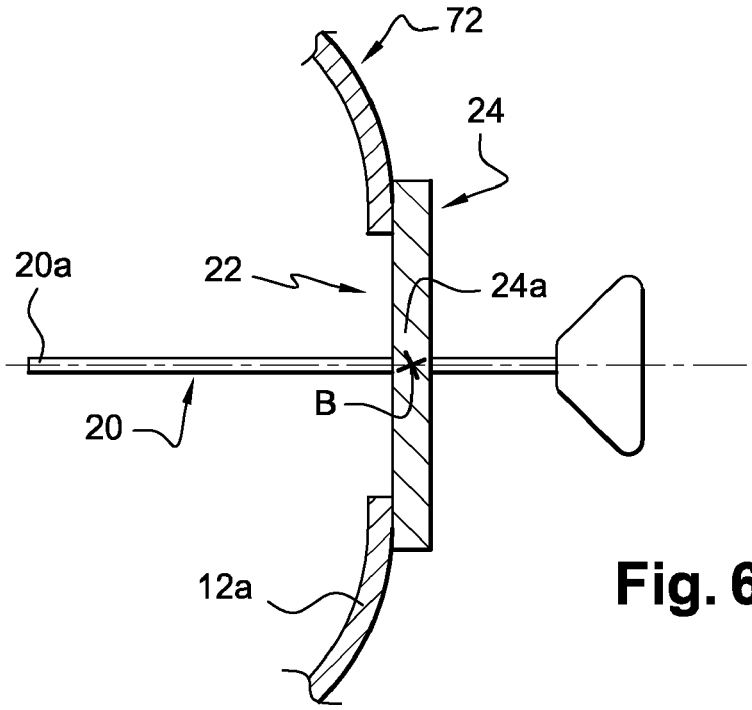
FIGS. 6A and 6B are schematic upper representations of the rear driving member and of the rear membrane, showing the deformation of the membrane during the oscillating movement of the rear driving member.

As it can be seen in FIG. 6A, when the first driving member 14 is in its inactive rest position, i.e. when the palette 16 extends in a longitudinal vertical plane, the membrane 24 is also in a neutral position, i.e. the membrane 24 is here generally planar and having a main transverse and vertical orientation.

Figure 6B:
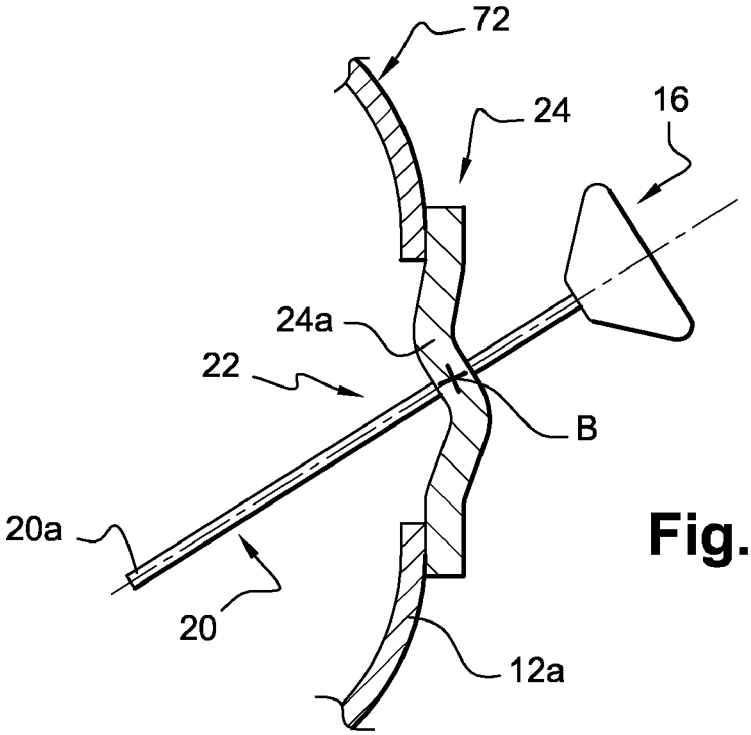

When the first driving member 14 is in an actuating position, as illustrated in FIG. 6B, it has pivoted around the vertical axis B. The membrane 24 is then elastically deformed and in a symmetrical manner around the vertical axis B.

Here, the deformation of the membrane 24 consists generally in a rotation of its central portion 24*a* around the vertical axis B, in a manner identical to the rotation of the first driving member 14.

As explained previously, the membrane 24 is here deformable elastically.

The stiffness of the membrane 24 is then determined so as not to block the oscillation or pivoting of the first driving member 14 around the vertical axis B. On the other hand, this stiffness of the membrane is determined so as to prevent any non desired pivoting of the first driving member 14 around the vertical axis B, or around a generally transverse axis.

Also, the stiffness of the membrane 24 is determined to maintain the first driving member 14 in a longitudinal position with respect to the body 12 by exerting on the first driving member 14 an elastic returning effort toward the position illustrated in FIG. 6A.

On the other hand, the membrane 24 can also not exert a returning effort of the first driving member 14 toward the rest position because this return is obtained by the actuating means 18 of the first driving member 14.

It has been represented in FIG. 4 a detail of the connection of the connecting portion 20 with the actuating means 18 of the first driving member 14.

As it has been explained previously, the connecting portion 20 cooperates with the actuating means 18 at the level of its longitudinal front free end 20*a*.

The actuating means 18 comprises an actuator 28 which consists here of a servo-motor, and of a linkage 30 connecting the actuator 28 to the connecting portion 20.

The linkage comprises a longitudinal fork 32 which is mounted articulated with respect to the body 12 around a vertical axis B1, and it extends longitudinally, toward the rear, from this B1 vertical axis.

The rear free end 32*a* of the fork 32 is generally planar and horizontal, and it comprises two transversely aligned longitudinal fingers 34 between which the free end 20*a* of the connecting portion 20 is received.

To this end, the free end 20*a* of the connecting portion 20 is in the shape of a vertical stem, which is adapted to slide freely between the two fingers 34, along the main axis of the fork 32, and to pivot between the fingers 34 around its vertical main axis. To provoke the pivoting of the first driving member 14, the actuator 28 and the linkage 30 are designed so as to provoke a pivoting of the fork 32 around its B1 articulation axis in a determined direction.

By pivoting, the fork 32 drives the front free end 20*a* of the connecting portion 20 in a generally transverse displacement along a direction associated with the pivoting of the fork 32.

The space wiped by the fork 32 is relatively reduced. This embodiment of the actuating means 18 of the first driving member 14, by the fork 32, is thus particularly adapted for the mounting of the actuating means 14 at the level of a rear longitudinal end 12*a* of the body, at the level of which the internal diameter of the body is relatively reduced, and thus at a place where the internal volume of the body is limited, whereas the volume of the actuating means 18 is more substantial.

As previously explained, the flexible membrane 24 performs a guiding of the first driving member 14 around the vertical axis B. Consequently, the transverse displacement of the free end 20*a* of the connecting portion 20 provokes a pivoting of the first driving member 14 around the vertical axis B. The use of a servo-motor as an actuator 28 permits to define the oscillating movement of the first driving member 14 around the vertical axis B, so that it is possible to have a symmetrical oscillation with respect to the main longitudinal axis A of the body 12, to perform the propulsion of the apparatus 10 toward the front, or to have an oscillation of the first driving member 14, at only one side with respect to the main longitudinal axis A of the body 12, for modifying the direction toward which the apparatus 10 is going.

As previously explained, the apparatus 10 comprises a first driving member 14 for the displacement of the apparatus 10 in a horizontal plane, with respect to the main longitudinal axis of the body 12.

The actuating means also comprises a second driving member 36 which is designed in order to cooperate with the liquid medium to provoke a displacement of the apparatus 10 in a longitudinal vertical plane with respect to the horizontal main axis A of the body 12.

Here, the second driving member 36 makes it possible to propel the apparatus 10 longitudinally toward the rear and it permits to modify the orientation of the apparatus 10 around a generally vertical axis, also called "attitude".

The second driving member 36 is of a structure generally identical to the first driving member 14. On the other hand, as it can be seen in the figures, the second driving member 36 is arranged at the level of the longitudinal front end 12*b* of the body 12, and it is mounted movable in oscillation with respect to the body 12, around a transverse axis C located at the level of the front end 12*b* of the body 12.

The second driving member 36 thus comprises a front palette 38, transverse and longitudinal, which is arranged longitudinally ahead and outside the body 12, and a connecting portion 42, which connects the front palette 38 to the actuating means 40 arranged inside the hollow body 12 and which extends through a front opening 44 realized in the longitudinal front end 12*b* of the body 12.

The front palette 38 here comprises openings 39 which are arranged on both sides of the main longitudinal axis A of the apparatus 10. These openings 39 provide with a flexibility of the palette around a transverse axis, during the propulsion of the apparatus 10 longitudinally toward the rear.

In a manner similar to the actuating means 18 of the first driving member 14, the actuating means 40 of the second driving member 36 comprises an actuator 46 and one linkage 48 which act on the rear longitudinal end 42*a* of the connecting portion 42 via a vertical front fork 48, longitudinal and vertical, which is mounted articulated with respect to the body 12 around a transverse axis C1.

In accordance with the invention, the front opening 44 of the body 12 is sealed in a fluid tight manner by a flexible front membrane which is similar to the flexible membrane 24 which seals the rear opening 22 of the body 12.

Thus, in accordance with the invention, the flexible front membrane 50 performs the guiding in pivoting of the second driving member 36 around the transverse front axis C.

According to the embodiment of the apparatus which has just been described, the apparatus comprises a first driving member 14 for the displacement of the apparatus 10 in a horizontal plane and a second driving member 36 for the displacement of the apparatus 10 in a vertical longitudinal plane.

Figure 9:
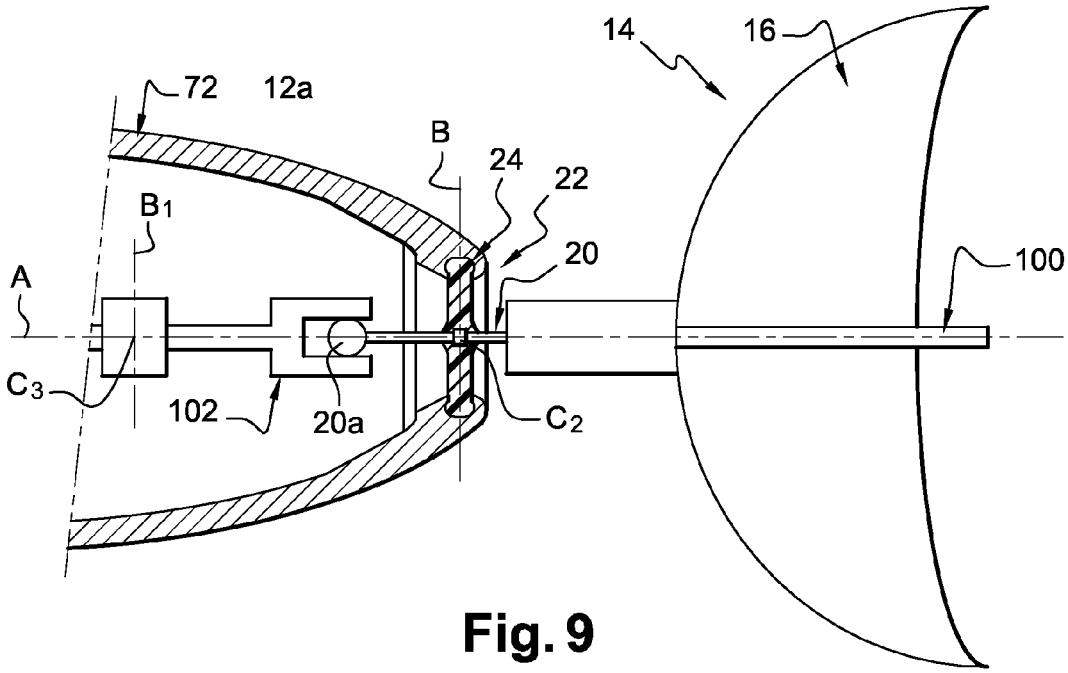
FIG. 9 is a view similar to the view of FIG. 5, showing an alternative embodiment of the rear driving member that is movable in oscillation around a vertical axis and around a transverse axis.

It has been illustrated in FIG. 9 an alternative embodiment of the apparatus 10 according to the invention for which the first driving member 14 is designed so as to cooperate with the liquid medium for the displacement of the apparatus 10 in a horizontal plane and in a longitudinal vertical plane.

The first driving member 14 is then the unique driving member of the apparatus 10 in these two planes.

To this end, the first driving member 14 is articulated with respect to the rear end of the body 12 around the rear vertical axis B and around a rear transverse axis C2.

According to the invention, the first driving member 14 comprises a connecting portion 20 which extends through the rear opening 22 and which is connected to the rear end 12*a* of the body 12 via the rear membrane 24.

Also, according to the invention, the rear membrane 24 makes it possible to realize the articulation of the first driving member 14 around the rear vertical axis B and around the rear transverse axis C2.

The first driving member 14 then comprises two palettes arranged at straight angle one with respect to the other, around the longitudinal axis A of the apparatus 10. A first palette 16 extends in a longitudinal vertical plane, for the displacement of the apparatus 10 in a horizontal plane, and a second palette 100 extends in a horizontal plane for the displacement of the apparatus 10 in a longitudinal vertical plane.

The actuating means 18 of the first driving member 14 around the rear vertical axis B and around the rear transverse axis C2 are designated so as to exert, on the longitudinal front end 20*a* of the connecting portion 20, a generally vertical action and/or a generally transverse action.

To this end, the front end 20*a* of the connecting portion 20 is of spherical shape and is received in a tubular element 102 of the linkage 30 which is articulated around a B1 vertical axis and a C3 transverse axis which are shifted toward the front with respect to the front end 20*a* of the connecting portion 20.

This tubular element 102 is connected to the actuator 28 via the linkage.

In the embodiment illustrated in the figures, and as it has been previously explained, the front membrane 50 and the rear membrane 24 are each one in the shape of disc which is manufactured by overmoulding around the connecting portion 42, 20 of the driving member 36, 20.

According to another embodiment, not illustrated, each membrane is manufactured by overmoulding around the associated connecting portion, in a manner such that the membrane comprises a portion in the shape of a disc, similar with the one previously described, which performs the connection and the articulation of the associated connecting portion with the body 12. The membrane also comprises an outer portion which extends longitudinally outside the body and that covers the entirety of the outer portion of the associated connecting portion.

The outer portion of the membrane is in a generally cylindrical shape having a longitudinal main axis, and it is adapted to be received in a cylindrical housing which is complementary to the associated palette. The connection between the outer portion of the membrane is designed to permit a transmission of the oscillation movement of the connecting portion to the associated palette.

Thus, only the internal portion of the connecting portion, which is connected to the driving means, is not covered by the material constituting the membrane.

According to an alternative embodiment, the outer portion of the membrane comprises longitudinal flattened portions, which cooperate with bearing zones which are complementary to the cylindrical housing of the associated palette. These flattened portions especially make it possible to prevent the pivoting of the palette around the main longitudinal axis of the apparatus 10.

According to still another aspect of the apparatus 10 according to the invention, the actuating means comprises a third driving member 52 which is carried out in order to provoke a vertical displacement, upward or to the bottom, of the apparatus 10 in the liquid medium.

The third driving member 52 is designed in order to modify the general density of the apparatus 10 with respect to the density of the ambient medium. According to the invention, the change of the density of the apparatus is obtained by modifying the volume of the apparatus, while preserving a constant mass of the apparatus, unlike the systems of ballast equipping the submarines which modify the general mass of the apparatus without modifying his volume.

Figure 7:
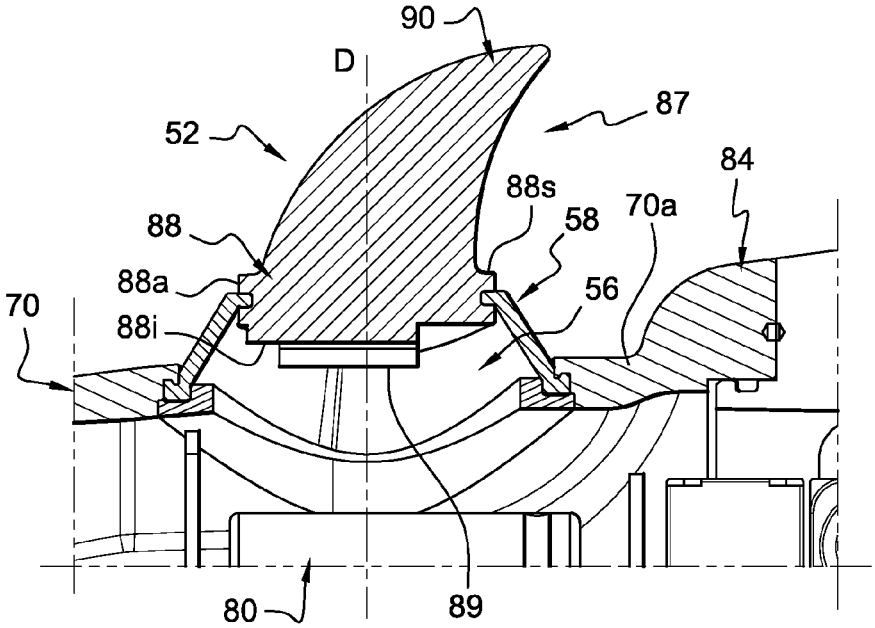
FIG. 7 illustrates a detail, in section along a longitudinal vertical plane, of the upper portion of the apparatus showing the means for modifying the density of the apparatus.
Figure 8:
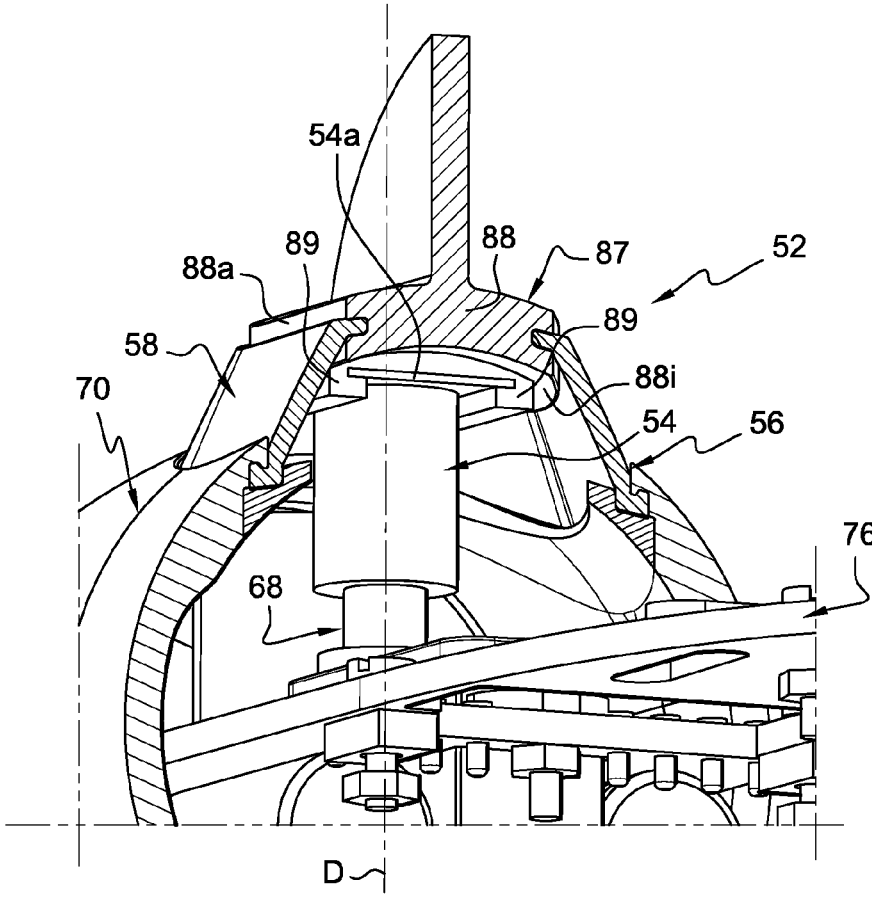
FIG. 8 illustrates a detail in perspective of the apparatus illustrated in FIG. 7, showing the driving piston of the plunger.

To this end, as one can see it especially in FIGS. 2, 7 and 8, the third driving member 52 comprises a piston 54 which is mounted movable with respect to the body along a vertical axis D, through an opening 56 which is centered on this vertical axis D.

Here, the opening 56 is realized at the front hull 70, and it will be called the upper opening 56.

The third driving member 52 also comprises a plunger 87 which is mounted slidably axially through the upper opening 56 along the vertical axis D, under the action of the piston 54.

According to the invention, the upper opening 56 is sealed by an upper flexible membrane 58 which cooperates with the piston 54 and the plunger 87 to modify the density of the apparatus 10.

To this end, the upper membrane 58 connects a peripheral edge of the plunger 87 to the edge of the opening 56 and it is adapted to be deformed elastically depending on the position of the plunger 87 along the vertical axis D.

The plunger 87 comprises a palette 88 which is radial with respect to the vertical axis D and which is connected to the membrane 58 at the level of its radial end edge 88*a*.

Here, the shape of the palette 88 is determined so as to prolong the shape of the front half hull 70, so that the apparatus 10 preserves a pleasant visual aspect.

The internal lower face 88*i* of the palette 88 is connected to the piston 54, here via a longitudinal slider 89 fixed to the palette 88, which receives a complementary longitudinal upper portion 54*a* of the piston 54.

The upper face 88*s* of the palette 88 is located outside the hull 12 of the apparatus 10 and it is adapted to come directly in contact with the liquid medium in which the apparatus 10 is intended to be plunged.

Here, the upper face 88*s* of the palette 88 also comprises an upper rib 90 which is in the shape of a fin, and which cooperates with the aesthetic global aspect of the apparatus to provide it with a resemblance to a fish or to another aquatic animal.

The upper rib 90 can also cooperate with the liquid medium to guide the apparatus 10 during its displacement toward the front.

The piston 54 is movable along the vertical axis between a low position (not illustrated) for which the apparatus 10 has a given density, toward one or several actuating upper positions, the extreme upper position of which is illustrated in FIGS. 7 and 8, for which the density of the apparatus 10 is reduced, which results in driving the apparatus in vertical displacement upward.

Here, the upper membrane 58 is realized in a manner such that it is not deformed when the piston 54 is in the extreme upper position illustrated in FIGS. 7 and 8.

Thus, to deform the upper membrane 58, the piston 54 exerts an axial traction on the palette 88 downward, the upper membrane 58 is then folded up on itself, which makes it possible to reduce the efforts to be produced to deform the upper membrane 58.

According to an alternative embodiment, the membrane is adapted to be deformed elastically toward the top, beyond the rest position illustrated in FIGS. 7 and 8, which increases the vertical travel of the palette 88.

The piston 54 is then adapted to exert on the palette 88 a pushing effort directed toward the top, and a traction effort directed downward.

Figure 10:
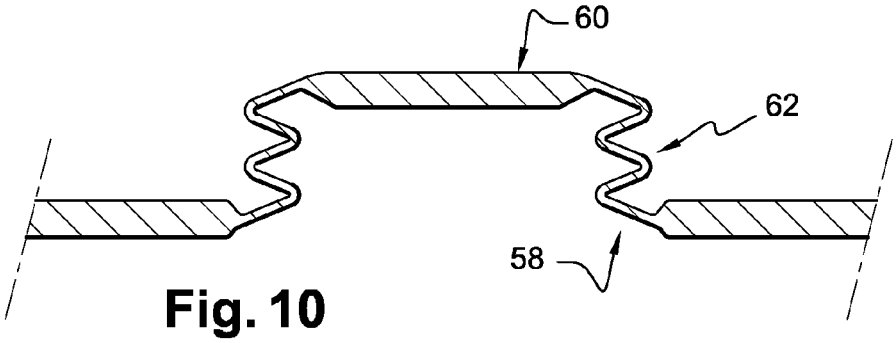
FIG. 10 is an alternative embodiment of the flexible membrane illustrated in FIGS. 7 and 8.

According to an alternative embodiment, illustrated in FIG. 10, the upper opening 56 is sealed only by the upper membrane 58 and the piston 54 acts on a central portion of the upper membrane 58 to modify the global volume of the apparatus.

According to this variant, the upper membrane 58 comprises a rigid central pastille 60 and one peripheral annular zone 62 surrounding the central pastille 60, which is adapted to become deformed elastically.

Thus, during the axial displacement of the piston 54, the central pastille 60 moves jointly with the piston 54, which makes it possible to have larger variations of the global volume of the apparatus 10.

According to a first aspect of this variant, the central pastille 60 is manufactured integral with the peripheral zone 62.

So that the pastille 60 be more rigid than the peripheral zone 62, the thickness of the pastille 60 is greater than the thickness of the peripheral zone.

According to a second aspect of this variant (not illustrated), the pastille 60 and the peripheral zone 62 are made out of two distinct materials. Preferably, the upper membrane 58 is manufactured by overmoulding of an elastically deformable material around the pastille made of rigid material, which makes it possible to ensure a good sealing of the upper membrane 58.

The actuating means 64 of the third driving member 52 comprises a third servo-motor 66 and one intermediate member 68 transforming the rotation of the servo-motor 66 in a translational movement of the piston 54. Here, the intermediate member 68 consists in a screw and nut system for which the screw or the nut is integral with the piston in translation and the nut, or the screw respectively, is rotated by the servo-motor 66.

As already explained before, each opening 22, 44, 56 of the body 12 is sealed by a membrane 24, 50, 58 which cooperates with a driving member 14, 36, 52 for the drive of the apparatus 10 in movement in the liquid medium.

According to a preferred embodiment of the invention illustrated in the figures, to seal the associated opening 22, 44, 56, each membrane 24, 50, 58 in an effective manner is manufactured before the realization of the half hulls 70, 72, and the half hulls are manufactured by moulding of a plastic material around the half hulls 70, 72.

Thus, the edge of each opening 22, 44, 56 is complementary to the edge of the associated membrane 24, 50, 58, thus guaranteeing a good sealing of the closing of the opening 22, 44, 56.

Moreover, each membrane 24, 50, 58 is traversed by a portion 20, 42, 87 of the driving member 14, 36, 52.

According to a preferred embodiment, that has been illustrated in the figures, for carrying out the sealing of the connection between each membrane 24, 50, 58 and the portion 20, 42, 87 of the associated driving member 14, 36, 52, each membrane 24, 50, 58 is manufactured by overmoulding of the constituent material of the membrane 24, 50, 58 around the portion 20, 42, 87 of the associated driving member 14, 36, 52.

According to an alternative embodiment, not illustrated, the membrane 24, 50, 58 is manufactured as a preliminary, before its fixing with the portion 20, 42, 87 of the driving member 14, 36, 52.

The membrane 24, 50, 58 then comprises an opening which is traversed by a portion complementary to the portion 20, 42, 87 of the driving member 14, 36, 52.

The fixing and the sealing of the connection of the membrane 24, 50, 58 with the associated portion 20, 42, 87 of the driving member 14, 36, 52 are performed by tightening of the portion 20, 42, 87 with the membrane 24, 50, 58, for example by crimping or tightening by an assembly of screws and nuts.

It will be understood that the invention is not limited to these embodiments for carrying out the fixing and the sealing between the membrane 24, 50, 58 and the associated portion 20, 42, 87 of the driving member 14, 36, 52, and that other modes of fixing and sealing can be used, without departing from the field of the invention.

As already explained before, the hollow body 12 is realized in a manner such that its radial section is greater at the level of the longitudinal centre of the body 12.

Also, the actuators 18, 40, 66 of the apparatus are elements of large dimensions with respect to the transverse section of the body close to one or the other of the two longitudinal ends 12*a*, 12*b* of the body.

Thus, the actuators 18, 40, 66 are arranged longitudinally at the level of the longitudinal centre of the body 12 offering a more substantial available space for these actuators 18, 40, 66.

Moreover, that makes it possible to balance the apparatus 10, so that its centre of gravity is centered longitudinally.

For the fixing of the actuators 18, 40, 66 inside the body, the apparatus 10 comprises a supporting plate 76 having a main horizontal orientation, on the horizontal faces thereof the actuators 18, 40, 66 are mounted.

The supporting plate 76 also supports an electronic device for controlling the actuators, as well as a source of energy 80. The control device is for example designed so that the apparatus 10 moves in an autonomous way in the liquid medium. It can moreover comprise wireless means of communication with a control unit (not illustrated) and/or with means for its localization.

The supporting plate 76 finally supports means for the articulation of the rear fork 32 around the B1 vertical axis and of the front fork 48 around the C1 transverse axis.

Finally, the apparatus 10 comprises a low skittle 78 which is mounted under the body 12 and which is carried out so as to vertically lower the centre of gravity of the apparatus 10 with respect to its geometric centre, to prevent any rotation of the apparatus around its longitudinal main axis. Here, the skittle 78 is mounted under the front half hull 70.

The mass of skittle 78 is determined to adjust the general mass of the apparatus 10 depending on the density of the liquid medium. The skittle 78 is thus mounted on the body in a dismountable manner, so as to be able to be exchanged with another skittle of a different mass.

Moreover, the skittle 78 is connected to the body by mounting means making it possible to adjust the longitudinal position of the skittle with respect to the body 12, to permit a longitudinal centering of the centre of gravity of the body 12.

To this end, and as it can be seen in FIGS. 2 and 3, the front half hull 70 comprises two longitudinal guide rails 92 which are received in complementary grooves 94 carried out in the skittle 78.

Also, the front half hull 70 comprises low transverse grooves 96 parallel ones with the others and longitudinally aligned, and the skittle 78 comprises a longitudinal lip 98 the free end of which is adapted to cooperate with one of the grooves 96 to block the skittle 78 in longitudinal position with respect to the front half hull 70.

The invention which has been just described refers to one or more flexible membranes among which each one is associated with a driving member of the apparatus 10 in displacement in the liquid medium.

It will be understood that the invention is not limited to this use of the flexible membranes, and that the apparatus can comprise other members which cooperate with the liquid medium, and which at least partly extend through an opening of the body 12 sealed by a flexible membrane.

For example, the apparatus comprises one or more proximity sensors, or feelers, among which each one comprises a stem extending toward the outer of the body 12, through an associated aperture. The outer end of the stem, which is located outside the body, is adapted to come in contact with a non specified outer object, and the internal end of the stem, which is located inside the body, is connected to an electronic device which detects each contact of the outer end of the stem.

The apparatus 10 then comprises a flexible membrane which seals the opening of the body which is traversed by this stem and which manufactured in accordance with the invention, in order to permit a movement of the stem with respect to the body, depending on the displacement of the stem with respect to the body.

The flexible membrane is thus traversed by the stem and it cooperates with the stem.

The invention claimed is:

1. Submersible apparatus (10) adapted to be submerged entirely in a liquid medium comprising:

a hollow body (12) closed in a fluid tight manner, having a main longitudinal axis (A);

at least one driving member (14, 36,) for moving the apparatus (10) in horizontal displacement and/or in vertical displacement, which is movable with respect to the hollow body (12) through an opening (22, 44,) arranged in the wall of the body (12) and which comprises at least one planar palette (16, 38, 100), of longitudinal main orientation, which extends outside the hollow body (12) and which is arranged at an axial end (12*a*, 12*b*) of the body (12) to cooperate with the medium in which the apparatus (10) is submerged;

actuating means (18, 40, 64) for actuating the driving member (14, 36, 52), which is arranged inside the hollow body (12);

a flexible membrane (24, 50, 58) to seal the opening (22, 44, 56) in a fluid tight manner, which is adapted to deform and to cooperate with the driving member (14, 36, 52) during the movement of the driving member (14, 36, 52) through the opening (22, 44, 56), for the displacement of the apparatus (10), the driving member (14, 36,) comprising a connecting portion (20, 42) of the palette (16, 38, 100), connecting the palette to the actuating means (18, 40), which extends through the flexible membrane (24, 50) in a fluid tight manner, characterized in that the driving member (14, 36) is guided in oscillation with respect to the body (12), around at least one pivoting axis (B, C, C2) perpendicular to the main longitudinal axis (A), via the flexible membrane (24, 50), said at least one pivoting axis (B, C, C2) located at the flexible membrane (24, 50); and another driving member (52) which is movable with respect to the body (12) so as to modify the total volume of the apparatus (10), characterized in that the said other driving member (52) comprises a central plunger (87) which is mounted movable with respect to the hollow body (12) along a vertical axis (D) and which is connected to the flexible membrane (58) to deform the membrane (58) generally along the said vertical axis (D).

2. Apparatus (10) according to claim 1, characterized in that the connecting portion (20, 42) comprises an internal axial end (20*a*, 42*a*) arranged inside the body (12), which cooperates with a generally longitudinal fork (32, 48) of the actuating means (18, 40), said fork (32, 48) being mounted articulated with respect to the body (12) around an axis (B1, Cl, C3) parallel with said at least one pivoting axis (B, C, C2) of the driving member (14, 36).

3. Apparatus (10) according to claim 2, characterized in that the body (12) has an oblong main shape of revolution around its main longitudinal axis (A) and the actuating means (18, 40, 64) comprises at least one actuator (28, 46, 66) arranged longitudinally close to the centre of the body (12).

4. Apparatus (10) according to claim 3, characterized in that the fork (32, 48) is arranged longitudinally near the axial end (12*a*, 12*b*) of the body (12), and in that the actuating means (18, 40, 64) further comprises a connecting linkage (30, 48) for connecting the actuator with the fork (32).

5. Apparatus (10) according to claim 3, characterized in that the actuator (28, 46, 66) is mounted on a supporting plate (76) which is fixed to the body (12).

6. Apparatus (10) according to claim 5, further comprising an electronic device for controlling the actuating means (18, 40, 64), which is mounted on the supporting plate (76).

7. Apparatus (10) according to claim 1, characterized in that the driving member (14) further comprises an horizontal palette (100).

8. Apparatus (10) according to claim 1, further comprising a further driving member (36) articulated with respect to the body (12) around another pivoting axis (C) of transverse orientation which is arranged at a front end (12*b*) of the body (12), and in that the further driving member (36) comprises a horizontal palette (38).

9. Apparatus (10) according to claim 1, characterized in that the plunger (87) of the said other driving member (52) is mounted movable with respect to the body (12), through the opening (56) which is coaxial with the said vertical axis (D).

10. Apparatus (10) according to claim 1, characterized in that the body (12) comprises two half hulls (70, 72).

11. Apparatus (10) according to claim 1, further comprising a lower skittle (78) which is fixed to the body (12) in a dismountable manner.

12. Apparatus (10) according to claim 11, characterized in that the skittle (78) is mounted so as to allow an adjustment of the position of the skittle (78) longitudinally with respect to the body (12).

* * * * *